US010302340B2

(12) United States Patent
Groshek

(10) Patent No.: US 10,302,340 B2
(45) Date of Patent: May 28, 2019

(54) COMPRESSOR HAVING LUBRICANT MANAGEMENT SYSTEM FOR BEARING LIFE

(71) Applicant: Emerson Climate Technologies, Inc., Sidney, OH (US)

(72) Inventor: Jacob A. Groshek, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 220 days.

(21) Appl. No.: 15/065,522

(22) Filed: Mar. 9, 2016

(65) Prior Publication Data

US 2016/0265820 A1 Sep. 15, 2016

Related U.S. Application Data

(60) Provisional application No. 62/131,325, filed on Mar. 11, 2015.

(51) Int. Cl.
*F25B 31/00* (2006.01)
*F25B 49/02* (2006.01)

(52) U.S. Cl.
CPC ..... *F25B 31/002* (2013.01); *F25B 49/022* (2013.01); *F25B 2500/16* (2013.01);
(Continued)

(58) Field of Classification Search
CPC ..... F25B 31/002; F25B 2500/16; F25B 2700/03; F25B 2700/195; F25B 2700/197;
(Continued)

(56) References Cited

U.S. PATENT DOCUMENTS 4,738,336 A 4/1988 Smith et al.
5,327,997 A 7/1994 Nash, Jr. et al.
(Continued)

FOREIGN PATENT DOCUMENTS

EP 1217216 A2 6/2002
EP 1909048 A1 4/2008
(Continued)

OTHER PUBLICATIONS

International Search Report regarding International Patent Application No. PCT/US2016/021792, dated Jun. 3, 2016.
(Continued)

*Primary Examiner* — Frantz F Jules
*Assistant Examiner* — Nelson J Nieves
(74) *Attorney, Agent, or Firm* — Harness, Dickey & Pierce, P.L.C.

(57) ABSTRACT

A lubricant management system is provided. The lubricant management system may include a compressor, at least one sensor, and a controller. The compressor may include a lubricant sump, a driveshaft, and a bearing assembly. The compressor may circulate a refrigerant. The lubricant sump may be configured for containing a lubricant. The bearing assembly may be supported by the driveshaft. The at least one sensor may be configured to determine at least one operating condition of the compressor. The controller may be in communication with the at least one sensor to receive the at least one operating condition. The controller may be configured to determine a lubricant film thickness from the at least one operating condition and compare the lubricant film thickness to a threshold lubricant film thickness.

11 Claims, 6 Drawing Sheets

(52) U.S. Cl.
CPC ..... *F25B 2700/03* (2013.01); *F25B 2700/195* (2013.01); *F25B 2700/197* (2013.01); *F25B 2700/21152* (2013.01)

(58) Field of Classification Search
CPC . F25B 2700/21152; F04B 1/122; F04B 39/02
See application file for complete search history.

(56) References Cited

U.S. PATENT DOCUMENTS

| | | | | |
|---|---|---|---|---|
| 5,543,983 | A | 8/1996 | Gregory et al. | |
| 5,590,539 | A * | 1/1997 | Marohl | F04C 23/00 123/196 AB |
| 6,017,205 | A | 1/2000 | Weatherston et al. | |
| 2002/0102163 | A1* | 8/2002 | Dudley | F04C 23/008 417/53 |
| 2003/0047386 | A1 | 3/2003 | Sherrington | |
| 2006/0219207 | A1* | 10/2006 | Toda | F02D 41/047 123/196 S |
| 2007/0175212 | A1* | 8/2007 | Uno | F01C 13/04 60/519 |
| 2009/0205349 | A1* | 8/2009 | Lifson | F04B 49/225 62/231 |
| 2010/0307173 | A1* | 12/2010 | Guo | F04C 18/0253 62/84 |
| 2012/0056571 | A1* | 3/2012 | Buse | F04B 17/03 318/558 |
| 2017/0314825 | A1* | 11/2017 | Scancarello | C10M 105/70 |

FOREIGN PATENT DOCUMENTS

| | | | |
|---|---|---|---|
| JP | 2006170575 | A * | 6/2006 |
| KR | 2005-0008893 | A | 1/2005 |

OTHER PUBLICATIONS

Written Opinion of the International Searching Authority regarding International Application No. PCT/US2016/021792, dated Jun. 3, 2016.

International Search Report regarding International Patent Application No. PCT/US2016/021792, dated Sep. 28, 2018.

* cited by examiner

COMPRESSOR HAVING LUBRICANT MANAGEMENT SYSTEM FOR BEARING LIFE

CROSS-REFERENCE TO RELATED APPLICATIONS

This application claims the benefit of U.S. Provisional Application No. 62/131,325, filed on Mar. 11, 2015. The entire disclosure of the above application is incorporated herein by reference.

FIELD

The present disclosure relates to a lubricant management system, and more particularly to a heating, ventilation, and air conditioning or refrigeration system having a lubricant management system for managing a film thickness of a lubricant on a bearing.

BACKGROUND

This section provides background information related to the present disclosure and is not necessarily prior art.

Bearings and bearing assemblies are used in various types of machinery and industrial equipment, such as scroll compressors. Proper lubrication of bearings and bearing assemblies is essential to successful operation of such machinery and industrial equipment. Specifically, lubricant may form a film or protective coating on the bearings or bearing assemblies. In this regard, at any given operating condition (e.g., speed, pressure, temperature, etc.) a bearing or bearing assembly may require, or otherwise be rated to operate with, a lubrication film having a specified or otherwise predetermined thickness to ensure the optimal performance of the compressor and a satisfactory operating life of the bearings or bearing assemblies. Accordingly, it is important to maintain or store a quantity of lubricant in the compressor or other piece of machinery. Often a compressor will include a lubricant sump or reservoir, and a lubrication monitoring system having a gauge and/or sensor to monitor the level or quantity of lubricant in the lubricant reservoir. The viscosity of the lubricant is also an important property to ensure the optimal performance of the compressor and a satisfactory operating life of the bearings or bearing assemblies. The viscosity of the lubricant is an important property of the oil to support the bearing loads within the compressor, reduce friction and wear between the compressor bearings and driveshaft and is also a factor in determining the lubricant film thickness. While known lubrication monitoring systems have proven acceptable for their intended purpose, a continuous need in the relevant art remains. Specifically, it may be desirable to provide a compressor having a lubricant management system that can accurately manage the lubrication of the bearings or bearing assemblies within the compressor.

SUMMARY

This section provides a general summary of the disclosure, and is not a comprehensive disclosure of its full scope or all of its features.

The present disclosure provides a lubricant management system. The lubricant management system may include a compressor, at least one sensor, and a controller. The compressor may include a lubricant sump, a driveshaft, and a bearing assembly. The compressor may circulate a refrigerant. The lubricant sump may be configured for containing a lubricant. The bearing assembly may be supported by the driveshaft. The at least one sensor may be configured to determine at least one operating condition of the compressor. The controller may be in communication with the at least one sensor to receive the at least one operating condition. The controller may be configured to determine a lubricant viscosity, compare the viscosity value to a threshold viscosity value and therefrom determine a lubricant film thickness from the at least one operating condition and compare the lubricant film thickness to a threshold lubricant film thickness.

In some configurations, the controller may provide an instruction to the compressor based on a difference between the actual lubricant viscosity and the threshold lubricant viscosity or based on a difference between the lubricant film thickness and the threshold lubricant film thickness.

In some configurations, the instruction may include changing a rotational speed of the driveshaft.

In some configurations, the instruction may include heating the lubricant.

In some configurations, the instruction may include communicating a warning to a user interface.

In some configurations, the instruction may include shutting down the compressor.

In some configurations, the lubricant management system may further include a first heat exchanger having a first fan, a second heat exchanger having a second fan, and an expansion valve.

In some configurations, the controller may provide an instruction to the first heat exchanger and/or the second heat exchanger based on a difference between the lubricant film thickness and the threshold lubricant film thickness, and the instruction may include changing the speed of the first fan and/or the second fan.

In some configurations, the controller may provide an instruction to the expansion valve based on a difference between the lubricant film thickness and the threshold lubricant film thickness, and the instruction may include one of opening and closing the expansion valve.

In some configurations, the at least one operating condition may include a viscosity of the lubricant, an angular velocity of the driveshaft, a temperature of a refrigerant or the lubricant, or a pressure of a refrigerant.

In some configurations, the controller may be configured to determine the threshold lubricant film thickness from at least one of an axially extending length of the bearing assembly, a diameter of the bearing assembly, and a gap between the bearing assembly and the driveshaft.

In some configurations, the compressor may include a viscometer disposed within the lubricant sump.

The present disclosure also provides a system for managing at least one property of a lubrication system. The system may include a bearing assembly, a motor, and a control module. The motor may include a driveshaft supported for rotation by the bearing assembly. The driveshaft may be configured to support a lubricant film between the driveshaft and the bearing assembly. The control module may be configured to determine a threshold value of at least one property. The control module may also be configured to compare the threshold value to an actual value of the at least one property. The control module may also be configured to determine a corrective action when the actual value is less than the threshold value. The at least one property includes a thickness of the lubricant film and a viscosity of the lubricant.

In some configurations, the bearing assembly may be disposed within a compressor.

In some configurations, the system may include a sensor in communication with the control module. The sensor may be configured to determine an operating condition of the compressor. The control module may be configured to determine at least one of the actual value and the threshold value from the operating condition.

In some configurations, the operating condition may include at least one of the viscosity of the lubricant, an angular velocity of the driveshaft, a temperature of a refrigerant or the lubricant, and a pressure of a refrigerant.

In some configurations, the controller may be configured to determine at least one of the threshold value and the actual value from at least one of an axially extending length of the bearing assembly, a diameter of the bearing assembly, and a gap between the bearing assembly and the driveshaft.

In some configurations, the corrective action includes at least one of modifying a rotational speed of the driveshaft, heating the lubricant, communicating a warning to a user interface, modulating a capacity of the compressor, and shutting down the motor.

The present disclosure also provides a heating, ventilation, and air conditioning system. The heating, ventilation, and air conditioning system may include the lubricant management system, a compressor, an evaporator, a condenser, and an expansion valve. The control module may communicate the corrective action to at least one of the compressor, the evaporator, the condenser, the expansion valve, and the motor.

The present disclosure also provides a compressor lubricant management method. The method may include determining an actual property. The actual property may include at least one of an actual thickness of a lubricant film and an actual viscosity of the lubricant. The method may also include determining a threshold property. The threshold property may include at least one of a threshold thickness of the lubricant film and a threshold viscosity of the lubricant. The method may also include comparing the actual property to the threshold property. The method may further include identifying a corrective action when the actual property is less than the threshold property.

In some configurations, the corrective action may include at least one of shutting down the compressor, communicating a warning signal, modulating a capacity of the compressor, modifying the temperature of the lubricant, and modifying a rotational speed of the driveshaft.

In some configurations, the corrective action may also include at least one of changing a speed of a condenser fan or an evaporator fan or changing one of opening and closing of an expansion valve.

In some configurations, the method may also include sensing an operating condition of a compressor.

In some configurations, the method may also include communicating the operating condition to a control module. At least one of the threshold property and the actual property may be determined from the operating condition.

In some configurations, the operating condition may include at least one of the actual viscosity, an angular velocity of a driveshaft, a temperature of a refrigerant or the lubricant, and a pressure of a refrigerant.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 6 is an example operating envelope for the compressor of FIG. 2.

Corresponding reference numerals indicate corresponding parts throughout the several views of the drawings.

DETAILED DESCRIPTION

Example embodiments will now be described more fully with reference to the accompanying drawings.

Figure 1:
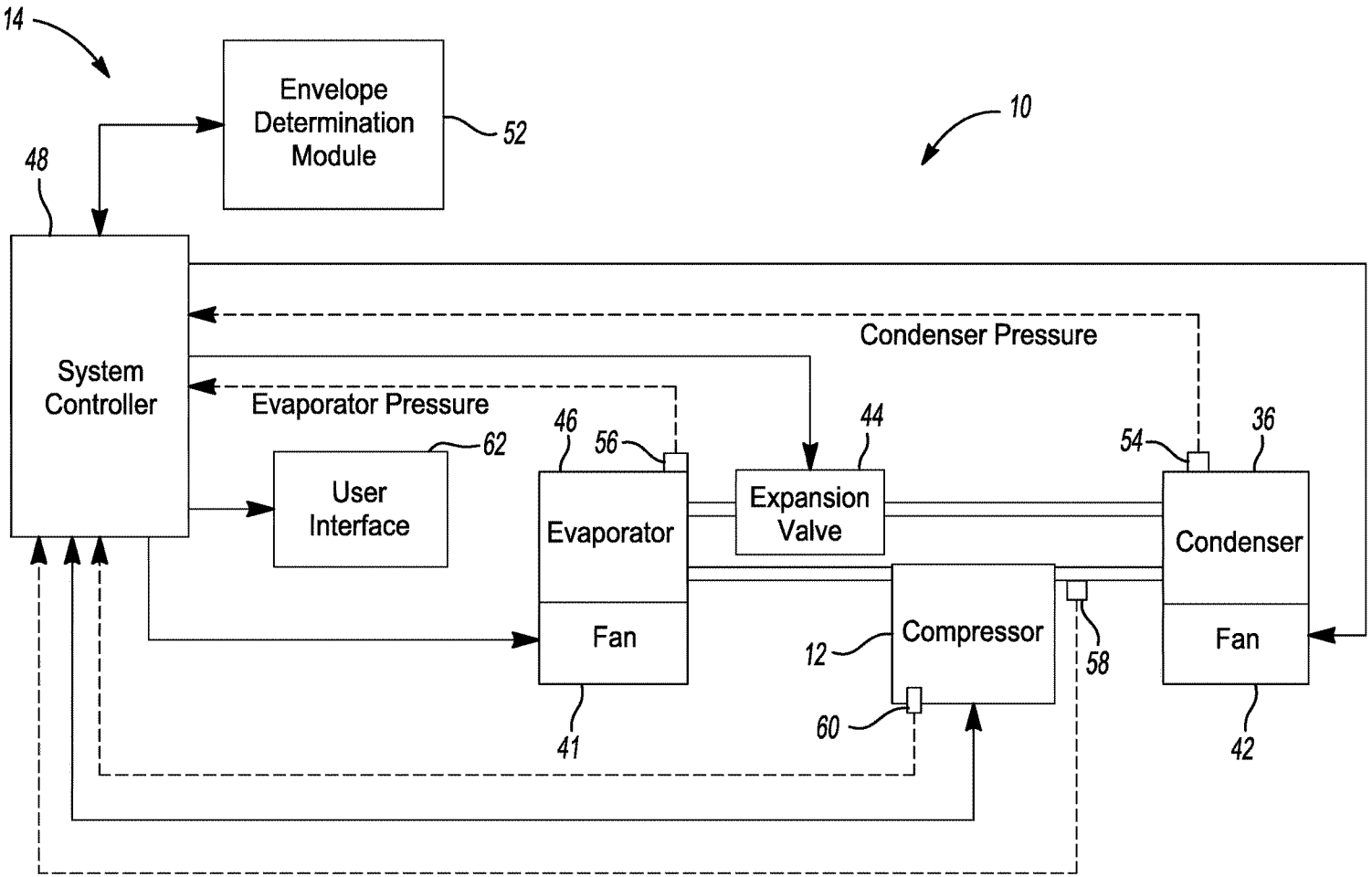
FIG. 1 is a block diagram of an example heating, ventilation, air conditioning or refrigeration (HVAC) system having a lubrication management system according to the principles of the present disclosure.
Figure 2:
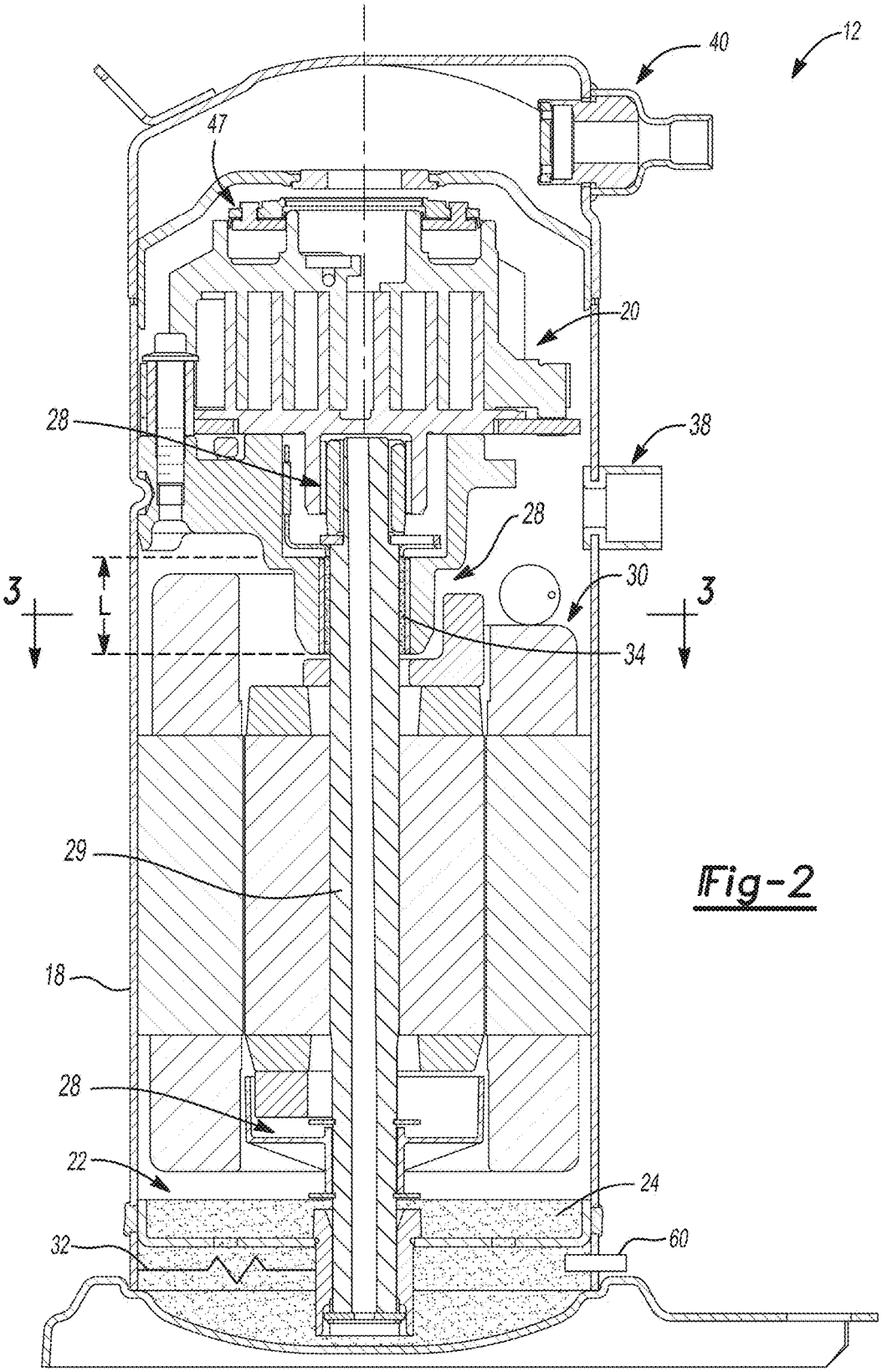
FIG. 2 is a cross-sectional view of a compressor of the HVAC system of FIG. 1.

With reference to FIG. 1, a heating, ventilation, air conditioning, or refrigeration (HVAC) system 10 constructed in accordance with the present teachings is illustrated. The HVAC system 10 can include a compressor 12 and a lubrication management system 14. A more detailed description of the compressor 12 may be found in commonly owned U.S. patent application Ser. Nos. 14/529,219 filed Oct. 31, 2014 and entitled "SCROLL COMPRESSOR", and Ser. No. 14/553,502 filed Nov. 25, 2014 and entitled "COMPRESSOR HAVING SOUND ISOLATION FEATURE," both of which are hereby incorporated by reference in their entirety. As illustrated in FIG. 2, the compressor 12 can include a shell 18 that houses a pump or compression mechanism 20. The shell 18 can include or otherwise define a lubricant sump 22. The compression mechanism 20 may include a rotary compression mechanism and/or a reciprocating compression mechanism, for example, and may be supported by at least one bearing or bearing assembly 28. As illustrated, in some configurations the compressor 12 can include three bearing assemblies 28. One or more of the bearing assemblies 28 may include a journal type bearing. It will be appreciated, however, that the bearing assemblies 28 may include other type(s) of bearings within the scope of the present disclosure. The bearing assemblies 28 can include certain bearing or bearing assembly geometry. For example, the bearings or bearing assemblies 28 can have certain geometric characteristics and tolerances such as a bearing length, a bearing diameter, and various gaps (e.g., annular gaps) between the bearing or bearing assembly 28 and a driveshaft 29.

Figure 3:
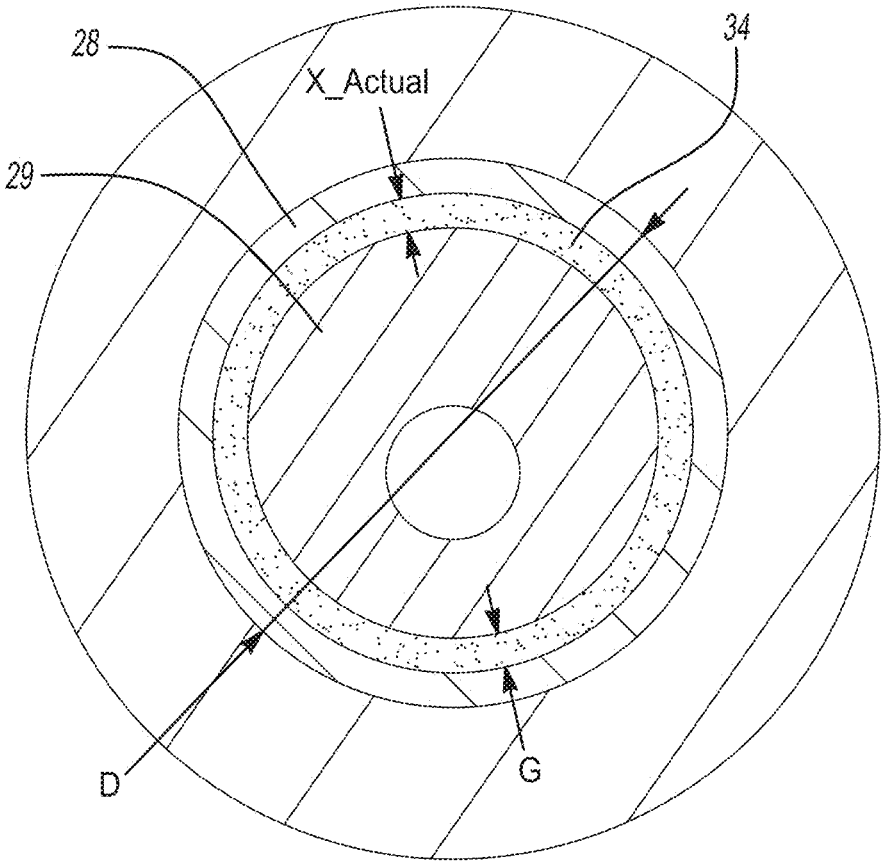
FIG. 3 is a cross-sectional view of a bearing assembly of the compressor of FIG. 2, taken through the line 2-2.

The driveshaft 29, driven by a motor 30, may rotate within the bearing assemblies 28 and drivingly engage the compression mechanism 20. The lubricant sump 22 may contain a lubricant 24, such as oil. In some configurations, the lubricant sump 22 may include a heater 32 configured to provide heat to, and thus increase the temperature of, the lubricant 24. As the compressor 12 operates, the lubricant 24 may be supplied to the bearing assemblies 28 to ensure optimal performance of the compressor 12 and the HVAC system 10. In this regard, the lubricant 24 may form a lubricant film 34 on the bearings or bearing assemblies 28. As illustrated in FIG. 3, the lubricant film 34 can have a thickness x_actual that varies based on the operational characteristics of the compressor 12 and the HVAC system 10, such as a rotational velocity of the driveshaft 29 and/or the viscosity of the lubricant 24, for example.

As will be described in more detail below, the compression mechanism 20 can compress refrigerant and deliver the compressed refrigerant to a condenser 36 (FIG. 1). In this regard, as illustrated in FIG. 2 the compressor 12 has a suction port 38 that receives refrigerant at a first or suction pressure, and a discharge port 40 that discharges the refrigerant at a second or discharge pressure that is higher than the suction pressure. The compressor 12 may also include a capacity modulation assembly 47. The capacity modulation assembly 47 can communicate with the compression mechanism 20 to reduce or otherwise alter the pressure and/or temperature of the refrigerant at the discharge port 40.

With reference to FIG. 1, a condenser fan 42 can blow air across the condenser 36 to facilitate heat transfer between the refrigerant and the condenser 36 and ambient air. Refrigerant from the condenser 36 is delivered through an expansion valve 44 to an evaporator 46. The expansion valve 44 controls the flow rate at which the refrigerant is supplied to the evaporator 46. The expansion valve 44 may include a thermostatic expansion valve or may be controlled electronically by, for example, a system controller. An evaporator fan 41 blows air across the evaporator 46 to facilitate heat transfer from the surrounding air to the refrigerant. The evaporator fan 41 may also serve to circulate conditioned air through the space being conditioned by the HVAC system 10. In another system, the condenser and/or evaporator can be replaced with a heat exchanger configured to transfer heat between the refrigerant and a liquid heat exchange medium instead of air. In this type of system, a pump would be used in place of the fan to circulate the heat exchange medium to transfer heat between the medium and the refrigerant. The heat exchange medium can include water, glycol, or any other liquid that can function to transfer heat to or from the refrigerant.

With continued reference to FIG. 1, the lubrication management system 14 can include a system control module or controller 48 and an envelope determination module 52. In some configurations the lubrication management system 10 can include or otherwise be part of the compressor 12, or other type of machinery. In other configurations the compressor 12, or other type of machinery, can include or otherwise be part of the lubrication management system 10. In this regard, while the lubrication management system 14 is generally described herein with respect to the compressor 12, it will be appreciated that the present teachings, including the lubrication management system 14, may be adapted for use in various types of machinery or industrial equipment. More specifically, the lubrication management system 14 may be adapted for use with any type of machinery or industrial equipment having a bearing or bearing assembly 28 supported by a driveshaft 29. As will be described in more detail below, the lubrication management system 14 can communicate with the HVAC system 10, including the compressor 12 or other machinery or equipment, to measure or otherwise monitor one or more characteristics (e.g., quantity, thickness, viscosity, etc.) of the lubricant 24 and/or the lubricant film 34.

The system controller 48 may control, or otherwise communicate with, various portions of the compressor 12 and/or the HVAC system 10 based on operating conditions or parameters that are measured by various sensors, and/or entered by a user, and thereafter communicated to the system controller 48. In this regard, the HVAC system 10 can include a condenser pressure sensor 54 that measures the refrigerant pressure at the condenser 36, and an evaporator pressure sensor 56 that measures refrigerant pressure at the evaporator 46. These pressures may be measured at an inlet, at an outlet, and/or at a middle position of the evaporator 46 or the condenser 36. The HVAC system 10 can also include a discharge temperature sensor 58 that measures a temperature of refrigerant at the discharge port 40, a viscometer 60 that measures a viscosity of the lubricant 24, and a temperature sensor (not illustrated) that measures a temperature of the lubricant in the lubricant sump 22. Each of the sensors can be in communication with the system controller 48.

The system controller 48 may communicate with the motor 30, the heater 32, the compression mechanism 20, the capacity modulation assembly 47, the evaporator fan 41, the condenser fan 42, the expansion valve 44, and/or a user interface 62 such as an output device or display. Specifically, and as will be described in more detail below, the lubrication management system 14, including the system controller 48 either individually or together with the envelope determination module 52, may obtain data and parameters from the various sensors and/or the user. Based on the obtained data and parameters, the lubrication management system 14 can monitor and manage a characteristic of the lubricant 24 and/or the lubricant film 34, and communicate with the HVAC system 10 to ensure the reliable and efficient operation of the compressor 12.

As described in more detail below, in some configurations the system controller 48 may communicate with the heater 32 to provide heat to, and thus increase the temperature of, the lubricant 24. The system controller 48 may also communicate with, or control the operation of, the compression mechanism 20. In this regard, in some configurations, the system controller 48 may communicate with the motor 30 to reduce the rotational velocity of the motor 30 and the driveshaft 29, and thus reduce the orbital or other operation speed of the compression mechanism 20. The system controller 48 may also communicate with the motor 30 to eliminate the rotation of the motor 30 and the driveshaft 29, and thus terminate the operation of the compressor 12. The system controller 48 may also communicate with the capacity modulation assembly 47. Specifically, the system controller 48 can communicate with the capacity modulation assembly 47 to control the temperature and/or pressure, for example, of the refrigerant in the compression mechanism 20. The system controller 48 may also communicate with the user interface 62 such that the user interface 62 communicates an audio or visual signal to a user, for example.

Figure 4:
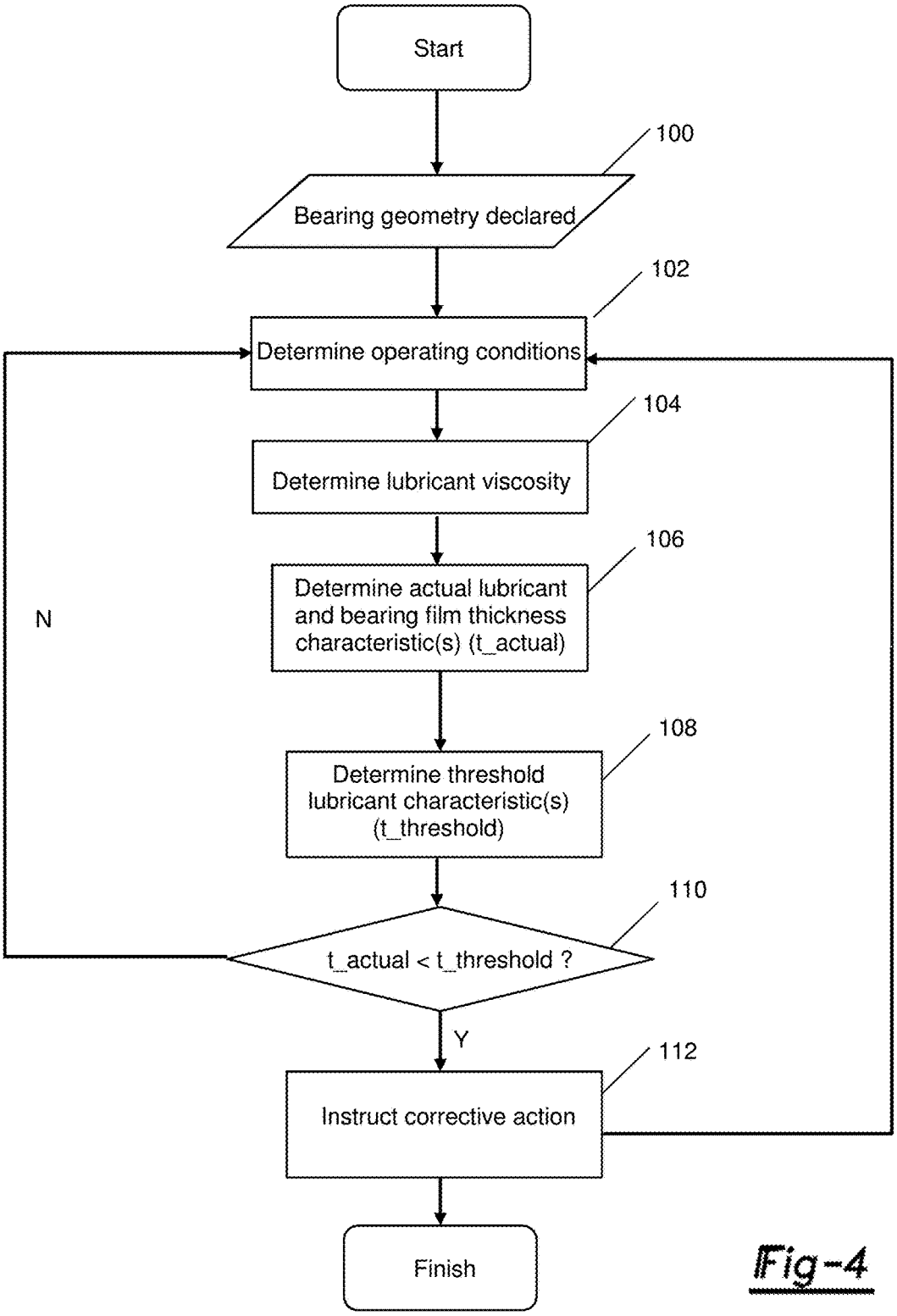
FIG. 4 is a flowchart depicting example operation of the lubrication management system of FIG. 1.

With reference to FIG. 4, a method of operating the HVAC system 10, including the lubrication management system 14, will now be described. Control begins at 100 where various characteristics of the bearing or bearing assembly 28 are obtained by, or otherwise declared as system inputs to, the system controller 48. In this regard, the various characteristics of the bearing or bearing assembly 28 may be programmed into system controller 48 before, during, or after assembly of the compressor 12. The various characteristics of the bearing or bearing assembly 28 may include, for example, geometric characteristics such as an axially extending length L (FIG. 2) of the bearing, a diameter D (FIG. 3) of the bearing, the shape of the bearing, a size of any gaps G (FIG. 3) between the driveshaft 29 and various components of the bearing assembly 28, etc. At 100, control may also include determining how the geometric characteristics may change or vary due to temperature or deflection upon rotation of the bearing 28.

Control continues at 102 where various operating conditions or parameters of the HVAC system 10 are obtained and communicated to the system controller 48. For example, operating conditions such as the rotational velocity of the driveshaft 29, the saturated condenser pressure, the saturated evaporator pressure, and/or the temperature of the lubricant 24 in the lubricant sump 22, for example, can be measured or otherwise obtained by various sensors (not shown) in the manner described above. In some configurations the operating conditions can also be obtained from a Modbus signal sent to and/or received from the system controller 48.

Control continues at 104 where the viscosity of the lubricant 24 is determined. The viscosity of the lubricant 24 can be determined in various ways. For example, as illustrated in FIGS. 1 and 2, in some configurations the HVAC system 10 may include the viscometer 60. The viscometer 60 may be disposed within the lubricant sump 22 and in communication with the system controller 48. Accordingly, the viscometer 60 can measure the viscosity of the lubricant 24 in the lubricant sump 22, and communicate the measured viscosity to the system controller 48 where it can be stored or saved for subsequent use. In other configurations the viscosity of the lubricant 24 can be calculated, or otherwise inferred, from operational variables of the HVAC system 10. For example, as illustrated in FIG. 5, in some configurations, the viscosity of the lubricant 24 can be calculated or inferred from a plot or table establishing a relationship between various measured pressures and/or temperatures in the HVAC system 10.

Figure 5:
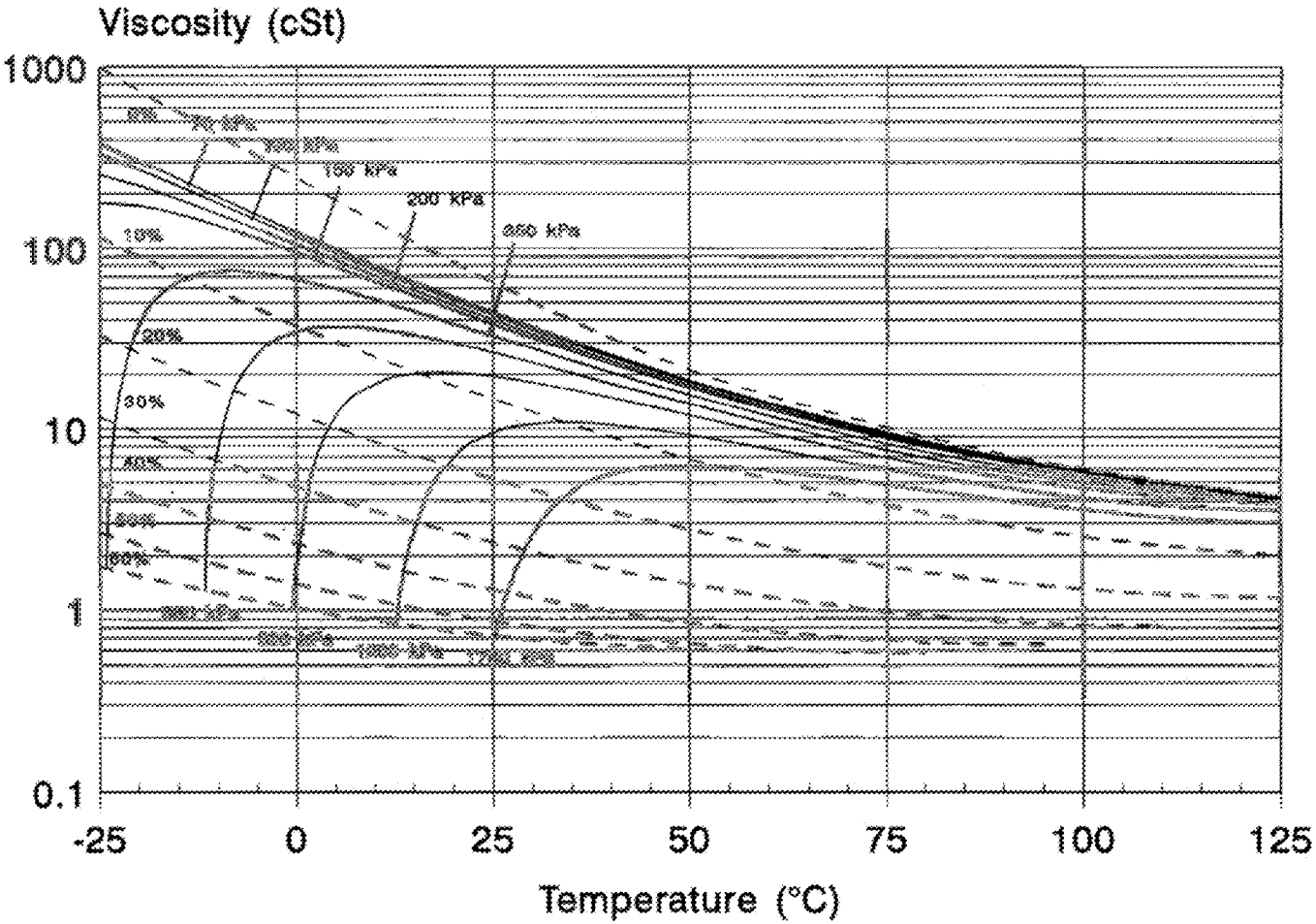
FIG. 5 is an example viscosity determination graph for the lubrication management system of FIG. 1.
Figure 9:
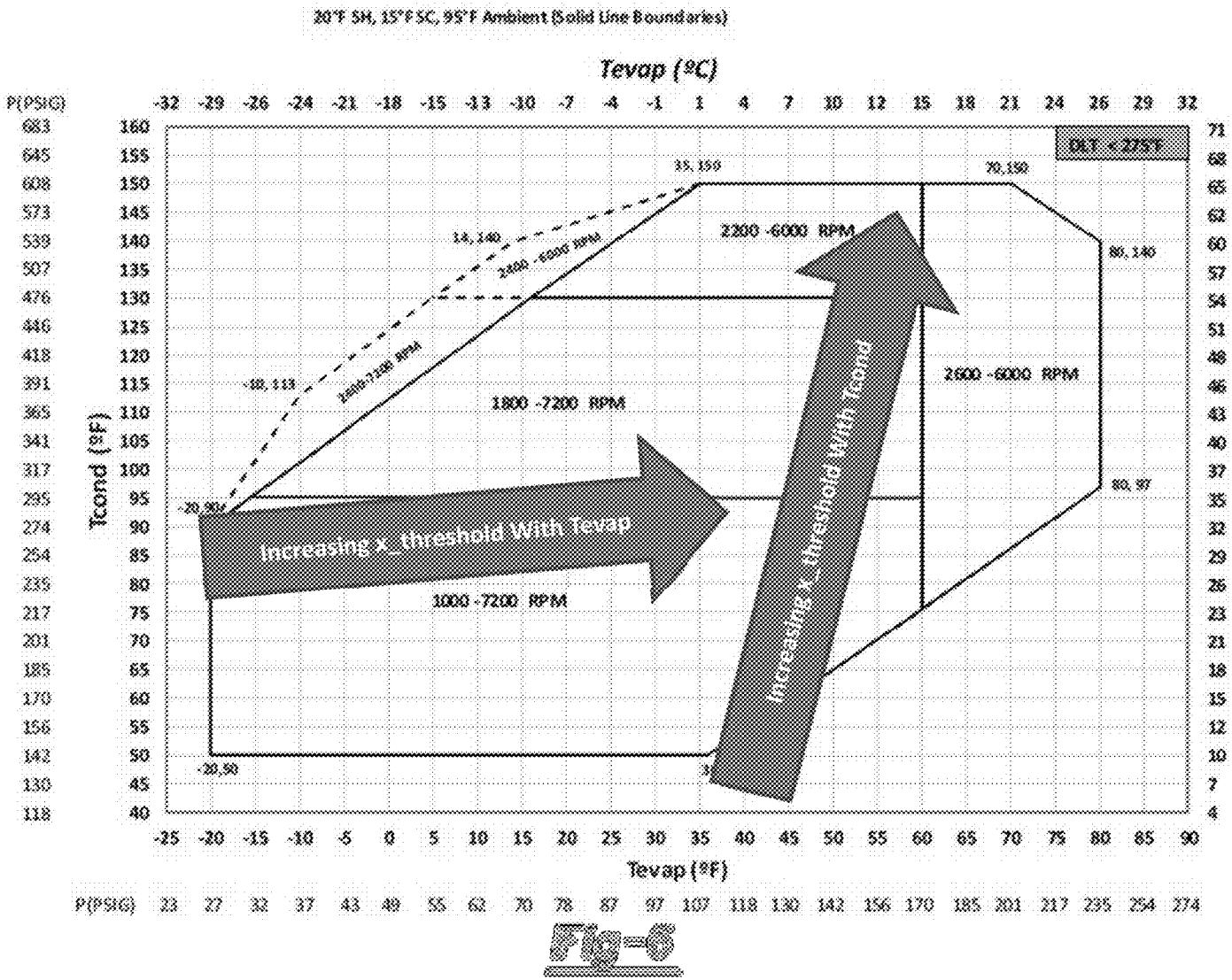

As shown in FIG. 5, different combinations of refrigerant and lubricant present different curve shapes. The relationships between viscosity and temperature change, but the basic algorithm and premise do not. A position on the curve may be determined by measuring or calculating pressure and temperature, referencing the pressure and temperature on the curve to determine viscosity (or get it from a viscometer), calculating film thickness, and taking action if necessary. When taking action to improve viscosity or thickness, the nonlinear shape of the curves prevents a command to simply increase the temperature. If the current viscosity/temperature/pressure point is on the right hand side of the parabola, increasing temperature decreases viscosity. But if the current viscosity/temperature/pressure point is on the left hand side of the curve, increasing temperature increases viscosity. Therefore, flexibility to increase or decrease superheat is a necessity.

For example, in an HVAC system 10 utilizing a low-side compressor 12, the measured pressure may be the saturated evaporator pressure measured by the evaporator pressure sensor 56, and the measured temperature may be the temperature of the lubricant measured by a dedicated sensor in the lubricant sump 22. In an HVAC system 10 utilizing a high-side compressor 12, the measured pressure may be the saturated condenser pressure measured by the condenser pressure sensor 54, and the measured temperature may be the temperature of the refrigerant measured by the discharge temperature sensor 58 or the temperature of the lubricant measured by a dedicated sensor in the lubricant sump 22. The calculated or inferred viscosity can then be communicated to the system controller 48 where it can be stored or saved for subsequent use.

Once the characteristics of the bearing or bearing assembly 28, the operating conditions, and the viscosity of the lubricant 24 are communicated to and/or stored in the system controller 48, control continues at 106 where actual values of one or more characteristics t_actual of the lubricant 24 and/or the lubricant film 34 are determined or otherwise obtained. For example, the characteristic t_actual can include the viscosity v_actual of the lubricant 24. The characteristic t_actual can also include the thickness x_actual of the lubricant film 34 on the bearing or bearing assembly 28. In this regard, once the necessary inputs have been determined or otherwise obtained in the manner described above, control at 106 can include calculating a Sommerfeld number B for the bearing or bearing 28 as follows:

$$B = \left(\frac{\eta\omega rw}{\pi W}\right)\left(\frac{r}{c}\right)^2$$

η=absolute viscosity at pressure=0 and constant temperature

ω=angular velocity of the bearing or bearing assembly r=radius of bearing or bearing assembly w=width of bearing or bearing assembly in a side-leakage direction W=radial load c=radial clearance of bearing or bearing assembly Using known relationships between the Sommerfeld number and the thickness x_actual of the lubricant film 34, as well the ratio between an eccentricity of the bearing 28 and the radial clearance of the bearing 28, control at 106 can also include determining the thickness x_actual of the lubricant film 34.

Control continues at 108 where one or more acceptable or threshold values of the one or more characteristics t_threshold of the lubricant 24 and/or the lubricant film 34 are determined or otherwise obtained. For example, the threshold characteristic t_threshold can include an acceptable range of values for the viscosity v_threshold of the lubricant 24. Similarly, the threshold characteristic t_threshold can include an acceptable range of values for the thickness x_threshold of the lubricant film 34 on the bearing or bearing assembly 28. Accordingly, the acceptable range of values of the characteristic t_threshold can define a minimum acceptable value for the characteristic of the lubricant 24 (e.g., viscosity) and/or the lubricant film 34 (e.g., thickness) at which the compressor 12 and the HVAC system 10 can reliably operate.

The acceptable values of the characteristic t_threshold can be calculated, or otherwise determined, based on the characteristics of the bearing or bearing assembly 28, the viscosity of the lubricant 24, and/or the operating parameters of the HVAC system 10. For example, the threshold value of the thickness x_threshold can be determined using an operating envelope for the compressor 12, such as the example operating envelope illustrated in FIG. 6. In the example operating envelope of FIG. 6, the X-axis represents evaporator pressure in pounds per square inch gage (psig), which corresponds directly to evaporator temperature. The Y-axis represents the condenser pressure in psig, which corresponds directly to condenser temperature. Condenser temperature and evaporator temperature are displayed in both degrees Fahrenheit and degrees Celsius. The operating envelope includes various regions defined by evaporator and condenser pressures and each region has a corresponding range of acceptable values for the characteristic t_threshold of the lubricant 24 or lubricant film 34 within which the compressor 12 can reliably operate. For example, as illustrated in FIG. 6, the operating envelope can define a corresponding range of acceptable values for the thickness x_threshold of the lubricant film 34. Alternatively, the operating envelope can define a corresponding range of acceptable values for the viscosity v_threshold of the lubricant 24.

Once the actual and threshold values of the characteristics t_actual, t_threshold of the lubricant 24 and/or the lubricant film 34 have been calculated or otherwise determined, control continues at 110 where the actual value of the characteristic t_actual is compared to the threshold value of the characteristic t_threshold. Specifically, control 110 determines whether the actual value of the characteristic t_actual is less than the threshold or acceptable value of the characteristic t_threshold. If the actual value of the characteristic t_actual is greater than or equal to the acceptable value of the characteristic t_threshold, control returns to 102 where the lubricant viscosity is determined in the manner described above. If the actual value of the characteristic t_actual is less than the acceptable value of the characteristic t_threshold, control continues to 112.

At 112, control initiates one or more actions to protect the compressor 12 and the HVAC system 10 from failure that might otherwise be caused by an unacceptable actual value of the characteristic t_actual of the lubricant 24 and/or the lubricant film 34. For example, as will be described in more detail below, in some configurations, control at 112 can include communicating a warning signal to the system controller 48. Control at 112 can also include adjusting the operating conditions of the compressor 12 and/or the HVAC system 10, and/or adjusting the viscosity of the lubricant 24. In this regard, the action(s) taken by control at 112 can cause an increase in the actual value of the viscosity v_actual of the lubricant 24 and/or an increase in the actual value of the thickness x_actual of the lubricant film 34. Accordingly, in some configurations, following 112 control can return to 102 where the actual viscosity is determined in the manner described above. For example, in some configurations, at 112 control can communicate a warning signal to the system controller 48, which can in turn communicate an audible or visual warning signal through the user interface 62, such as the output device or display, allowing the user to take appropriate remedial action. Following the communication of such warning signal, control can return to 102. In other configurations, at 112 control can shut down operation of the compressor 12. Because the viscosity is an important property related to bearing life, and used in the calculation for the bearing film thickness, the actual value of the viscosity v_actual can be compared to the threshold level v_threshold, and corrective action taken, before proceeding on to determining the bearing film thickness and taking action needed to correct a bearing film thickness value. The actual values of the viscosity and bearing film thickness, v_actual and t_actual, can also simultaneously be compared to their respective threshold values, and corrective actions taken to fix both lubrication properties can occur at the same time. In other words, the comparison and correction of each of the lubrication properties can occur in a series relationship with the comparison and correction of the viscosity occurring prior to the comparison and correction of the bearing film thickness, or in a parallel relationship with the comparison and correction of both the viscosity and bearing film thickness occurring simultaneously, which is possible because different actions are required to correct each of the lubrication properties, as described below.

In other configurations, at 112 control can adjust the operating conditions (e.g., speed, pressure, temperature, capacity, etc.) of the compressor 12 and/or the HVAC system 10. For example, if the compressor 12 includes a variable frequency drive, at 112 control can reduce the rotational speed of the motor 30, and thus the driveshaft 29. In another example, at 112 control can increase, or otherwise modify or change, the rotational speed of the motor 30, and thus the driveshaft 29 (for example only, the control may increase the rotational speed of the driveshaft 29 deliver more oil up the shaft). In another example, at 112 control can communicate with the capacity modulation assembly 47 to modulate or otherwise reduce the capacity of, and therefore the pressure within, the compression mechanism 20. In yet another example, at 112 control can communicate with the expansion valve 44 to modify or change the flow rate at which the refrigerant is supplied to the evaporator 46, which can modify or change the value of the viscosity v_actual of the lubricant 24. For example only, control can communicate with expansion valve 44 to increase the flow rate at which the refrigerant is supplied to the evaporator 46, which can increase the value of the viscosity v_actual of the lubricant 24, while also reducing the load on the bearing 28. The control may assess and determine a low or unacceptable film thickness, command the expansion valve 44 to change position, the expansion valve 44 may adjust to increase or decrease the superheat, the lubricant 24 temperature will change as a result of the change in superheat, and viscosity will improve as a result of the change in the lubricant 24 temperature.

In yet another example, at 112 control can change the speed of the condenser fan 42 or the evaporator fan 41 or change the position of the expansion valve 44. For example only, when the speed of the condenser fan 42 and/or evaporator fan 41 is increased or decreased, the properties of the lubricant 24 are also changed. Changing condenser fan speed ultimately affects the high side of a system. For a low side compressor, changing condenser fan speed may not have a direct impact, but for a high side compressor, changing condenser fan speed affects the conditions of the sump. Changing evaporator conditions affects the low side of a system. For a high side compressor, changing evaporator conditions may not directly make a change, but for a low side compressor, changing evaporator conditions changes the pressure at which the sump is operating. Referring to FIG. 5, changing evaporator conditions causes a jump in the curves. Since each line is a line of constant pressure on this chart, viscosity is affected not by changing temperature necessarily, but by changing curves.

When the position of the expansion valve 44 is changed, an increase or decrease in superheat is realized which also changes the properties of the lubricant 24. Viscosity may be improved by an increase in superheat until the point liquid Floodback is introduced to the system, and then liquid dilution becomes a concern.

In other configurations, at 112 control can adjust the viscosity of the lubricant 24. For example, at 112 control can communicate with the heater 32 to increase the temperature of the lubricant 24. With reference to FIG. 5, as the temperature of the lubricant 24 increases, the actual value of the viscosity v_actual can also increase.

The lubrication management system 14, and the method of operating the lubrication management system 14, can help to ensure that the compressor 12 operates reliably and in a way that does not damage the bearing or bearing assembly 28. In this regard, by actively managing and comparing the actual values of the lubricant characteristic t_actual to the threshold values of the lubricant characteristic t_threshold, the lubrication management system 14 can expand the operating envelope of the compressor 12 and extend the operating life of the bearing or bearing assembly 28.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The terms 'controller' or 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory circuits (such as a flash memory circuit or a mask read-only memory circuit), volatile memory circuits (such as a static random access memory circuit and a dynamic random access memory circuit), and secondary storage, such as magnetic storage (such as magnetic tape or hard disk drive) and optical storage.

The apparatuses and methods described in this application may be partially or fully implemented by a special purpose computer created by configuring a general purpose computer to execute one or more particular functions embodied in computer programs. The computer programs include processor-executable instructions that are stored on at least one non-transitory, tangible computer-readable medium. The computer programs may also include or rely on stored data. The computer programs may include a basic input/output system (BIOS) that interacts with hardware of the special purpose computer, device drivers that interact with particular devices of the special purpose computer, one or more operating systems, user applications, background services and applications, etc.

The computer programs may include: (i) assembly code; (ii) object code generated from source code by a compiler; (iii) source code for execution by an interpreter; (iv) source code for compilation and execution by a just-in-time compiler, (v) descriptive text for parsing, such as HTML (hypertext markup language) or XML (extensible markup language), etc. As examples only, source code may be written in C, C++, C#, Objective-C, Haskell, Go, SQL, Lisp, Java®, ASP, Perl, Javascript®, HTML5, Ada, ASP (active server pages), Perl, Scala, Erlang, Ruby, Flash®, Visual Basic®, Lua, or Python®.

None of the elements recited in the claims is intended to be a means-plus-function element within the meaning of 35 U.S.C. § 112(f) unless an element is expressly recited using the phrase "means for", or in the case of a method claim using the phrases "operation for" or "step for".

What is claimed is:

1. A system for managing at least one property of a lubricant, the system comprising:

a bearing assembly;

a motor having a driveshaft supported for rotation by the bearing assembly, the driveshaft configured to support a lubricant film between the driveshaft and the bearing assembly; and a controller configured to determine a threshold value of at least one of a thickness of the lubricant film and a viscosity of the lubricant, compare the threshold value to an actual value of the at least one of the thickness of the lubricant film and the viscosity of the lubricant, and determine a corrective action when the actual value is less than the threshold value, wherein the threshold value of the at least one of the thickness of the lubricant film and the viscosity of the lubricant is determined using an evaporator pressure or an evaporator temperature, a condenser pressure or a condenser temperature, and a rotational speed of the driveshaft, and wherein the corrective action includes at least one of modifying a rotation speed of the motor, modifying the rotational speed of the driveshaft, heating the lubricant, modulating a capacity of a compressor, modifying a flow rate at which refrigerant is supplied to an evaporator, adjusting a superheat, changing a speed of a condenser fan or an evaporator fan, changing a position of an expansion valve, and shutting down the motor.

2. The lubricant management system of claim 1, wherein the bearing assembly is disposed within the compressor, the system further comprising at least one sensor in communication with the controller and configured to determine an operating condition of the compressor, the controller configured to determine at least one of the actual value and the threshold value from the operating condition.

3. The lubricant management system of claim 2, wherein the operating condition includes at least one of the viscosity of the lubricant, an angular velocity of the driveshaft, a temperature of the refrigerant or the lubricant, and a pressure of the refrigerant.

4. The lubricant management system of claim 1, wherein the controller is configured to determine at least one of the threshold value and the actual value from at least one of an axially extending length of the bearing assembly, a diameter of the bearing assembly, and a gap between the bearing assembly and the driveshaft.

5. The lubricant management system of claim 1, wherein the corrective action includes communicating a warning to a user interface.

6. A heating, ventilation, and air conditioning system including the lubricant management system of claim 5, the heating, ventilation, and air conditioning system further comprising a compressor, an evaporator, a condenser, and an expansion valve, wherein the controller communicates the corrective action to at least one of the compressor, the evaporator, the condenser, the expansion valve, and the motor.

7. A compressor lubricant management method comprising:

determining an actual property, the actual property being at least one of an actual thickness of a lubricant film and an actual viscosity of a lubricant, the lubricant film being supported between a driveshaft and a bearing assembly;

determining a threshold property, the threshold property being at least one of a threshold thickness of the lubricant film and a threshold viscosity of the lubricant determined using an evaporator pressure or an evaporator temperature, a condenser pressure or a condenser temperature, and a rotational speed of the driveshaft;

comparing the actual property to the threshold property; and identifying a corrective action when the actual property is less than the threshold property, wherein the corrective action includes at least one of modifying a rotation speed of the motor, modifying the rotational speed of the driveshaft, heating the lubricant, modulating a capacity of a compressor, modifying a flow rate at which refrigerant is supplied to an evaporator, adjusting a superheat, changing a speed of a condenser fan or an evaporator fan, changing a position of an expansion valve, and shutting down the motor.

8. The method of claim 7, wherein the corrective action includes communicating a warning signal.

9. The method of claim 7, wherein the corrective action includes at least one of changing the speed of the condenser fan or the evaporator fan or changing one of opening and closing of the expansion valve.

10. The method of claim 7, further comprising:

sensing an operating condition of the compressor; and communicating the operating condition to a controller, at least one of the threshold property and the actual property determined from the operating condition.

11. The method of claim 10, wherein the operating condition includes at least one of the actual viscosity, an angular velocity of the driveshaft, a temperature of the refrigerant or the lubricant, and a pressure of the refrigerant.

* * * * *